US006994033B2

(12) United States Patent
Kweon

(10) Patent No.: US 6,994,033 B2
(45) Date of Patent: Feb. 7, 2006

(54) SHELF FOR REFRIGERATOR

(75) Inventor: Gyeong-Hwan Kweon, Busan (KR)

(73) Assignee: LG Electronics Inc., Seoul (KR)

( * ) Notice: Subject to any disclaimer, the term of this patent is extended or adjusted under 35 U.S.C. 154(b) by 140 days.

(21) Appl. No.: 10/316,053

(22) Filed: Dec. 11, 2002

(65) Prior Publication Data

US 2003/0117051 A1 Jun. 26, 2003

(30) Foreign Application Priority Data

Dec. 21, 2001 (KR) ..... 2001-82971

(51) Int. Cl.
*A47B 57/00* (2006.01)

(52) U.S. Cl. ..... 108/94; 312/408

(58) Field of Classification Search ..... 108/92, 108/93, 94, 65, 103, 59, 13; 211/153; 312/408, 312/410

See application file for complete search history.

(56) References Cited

U.S. PATENT DOCUMENTS

| | | | | | |
|---|---|---|---|---|---|
| 1,576,716 | A * | 3/1926 | Casgrain | 108/94 |
| 2,091,607 | A * | 8/1937 | Nave | 211/153 |
| 2,092,430 | A * | 9/1937 | Stratton | 211/153 |
| 2,319,470 | A * | 5/1943 | Nobles | 211/153 |
| 2,692,813 | A * | 10/1954 | Toronto | 312/408 |
| 4,763,582 | A * | 8/1988 | Rigsby | 108/103 |
| 5,540,493 | A * | 7/1996 | Kane et al. | 312/408 |
| 5,813,741 | A * | 9/1998 | Fish et al. | 312/408 |
| 6,497,184 | B1 * | 12/2002 | Whitesitt | 108/64 |

* cited by examiner

*Primary Examiner*—Jose V. Chen
(74) *Attorney, Agent, or Firm*—Fleshner & Kim, LLP

(57) ABSTRACT

A shelf for a refrigerator includes a shelf body for compartmentalizing a receiving space in a refrigerator, a space portion cut out at a certain portion of the shelf body, and an open/close plate rotatably mounted in the space portion. The open/close plate is configured to swing out of the way to open the space portion of the shelf body when a tall storage item is stored in the refrigerator.

32 Claims, 6 Drawing Sheets

SHELF FOR REFRIGERATOR

BACKGROUND OF THE INVENTION

1. Field of the Invention

The present invention relates to a shelf for a refrigerator and, more particularly, to a shelf for a refrigerator suitable to secure a space for receiving a tall stuff in a refrigerator.

2. Description of the Background Art

In general, a refrigerator, storing frozen stuffs and refrigerated stuffs, is widely adopted for a home use and an industrial use.

FIG. 1 is a perspective view showing a refrigerator in accordance with a conventional art.

As shown in FIG. 1, a refrigerator 1 includes a freezing chamber 3 formed at either side of an upper portion and a lower portion thereof and having a receiving space for storing a frozen stuff; a refrigerating chamber 5 compartmented by a wall from the freezing chamber 3; a freezing chamber door 8 and a refrigerating chamber door 9 opened and closed forwardly of the freezing chamber 3 and the refrigerating chamber 5; a cooling air supply unit (not shown) for supplying cooling air to the freezing chamber 3 and the refrigerating chamber 5; a plurality of shelves 7 mounted in the freezing chamber 3 and the refrigerating chamber 5 and compartmenting the receiving space for receiving frozen stuffs and refrigerated stuffs.

The shelf 7 has a cantilever shape formed of a plate with a predetermined thickness, being extended from a rear wall of the freezing chamber 3 and the refrigerating chamber 5 toward the doors 8 and 9. The shelf is detachably fixed at a shelf holder 10 installed at the rear wall of the freezing chamber 3 and the refrigerating chamber 5.

That is, the shelf 7 is detachably fixed at the freezing chamber 3 and the refrigerating chamber 5 to allow a user to enlarge or reduce the space (C) between the shelves 7 according to the size of storage stuff stored in the freezing chamber 3 and the refrigerating chamber 5, in order to receive more storage stuffs into the freezing chamber 3 and the refrigerating chamber 5.

However, the conventional refrigerator has the following problems.

That is, as shown in FIG. 2, in the conventional refrigerator 1, if a tall storage stuff 11 is received thereinto, in order to secure a receiving space for the storage stuff 11, the shelf 7 is separated from the freezing chamber 3 or from the refrigerating chamber 5 and stores the storage stuff 11.

At this time, since the shelf 7 can not be mounted at the space where the storage stuff 11 is placed, a receiving space is failed to be secured around the storage stuff 11, resulting a problem that it is not possible to store more storage stuffs.

In addition, when the tall storage stuff 11 is intended to be stored, other storage stuffs which have been already received on the shelf should be all removed therefrom and the shelf 7 should be separated from the freezing chamber 3 and the refrigerating chamber 5, so that operation for storing the storage stuff 11 is complicate and hard.

SUMMARY OF THE INVENTION

Therefore, an object of the present invention is to provide a shelf for a refrigerator suitable for securing a receiving space for receiving a tall storage stuff by allow a receiving space of upper/lower sides compartmented by shelves in a refrigerator to communicate at a certain portion thereof.

To achieve these and other advantages and in accordance with the purpose of the present invention, as embodied and broadly described herein, there is provided a shelf for a refrigerator including: A shelf body for compartmenting a receiving space in a refrigerator to receive a storage stuff and having a space portion cut out as large as a certain area at a certain portion; and an open/close plate rotatably mounted at the space portion of the shelf body and opening the space portion of the shelf body when a tall storage stuff is received.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
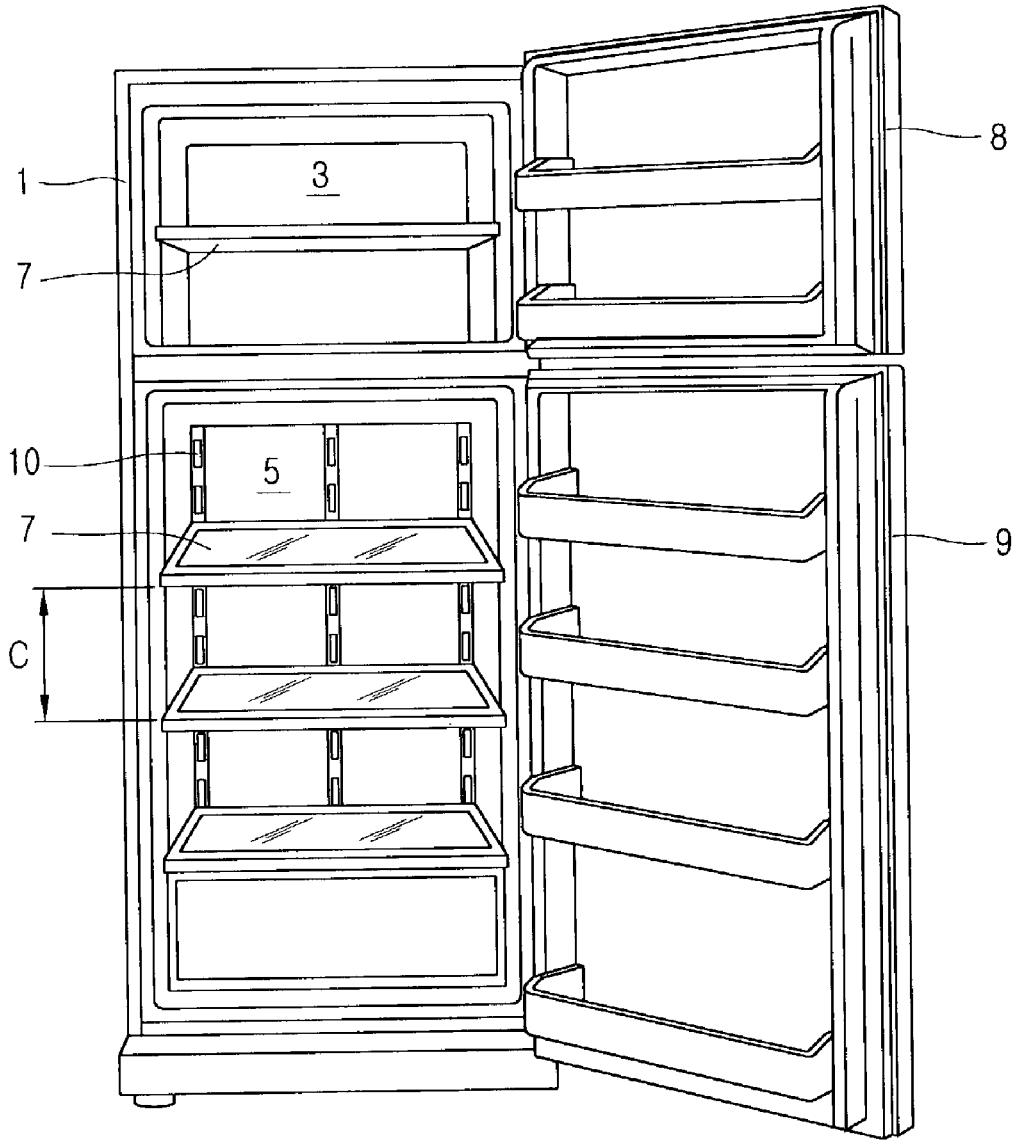
FIG. 1 CONVENTIONAL ART
FIG. 1 is a perspective view showing a refrigerator in accordance with a conventional art.
Figure 2:
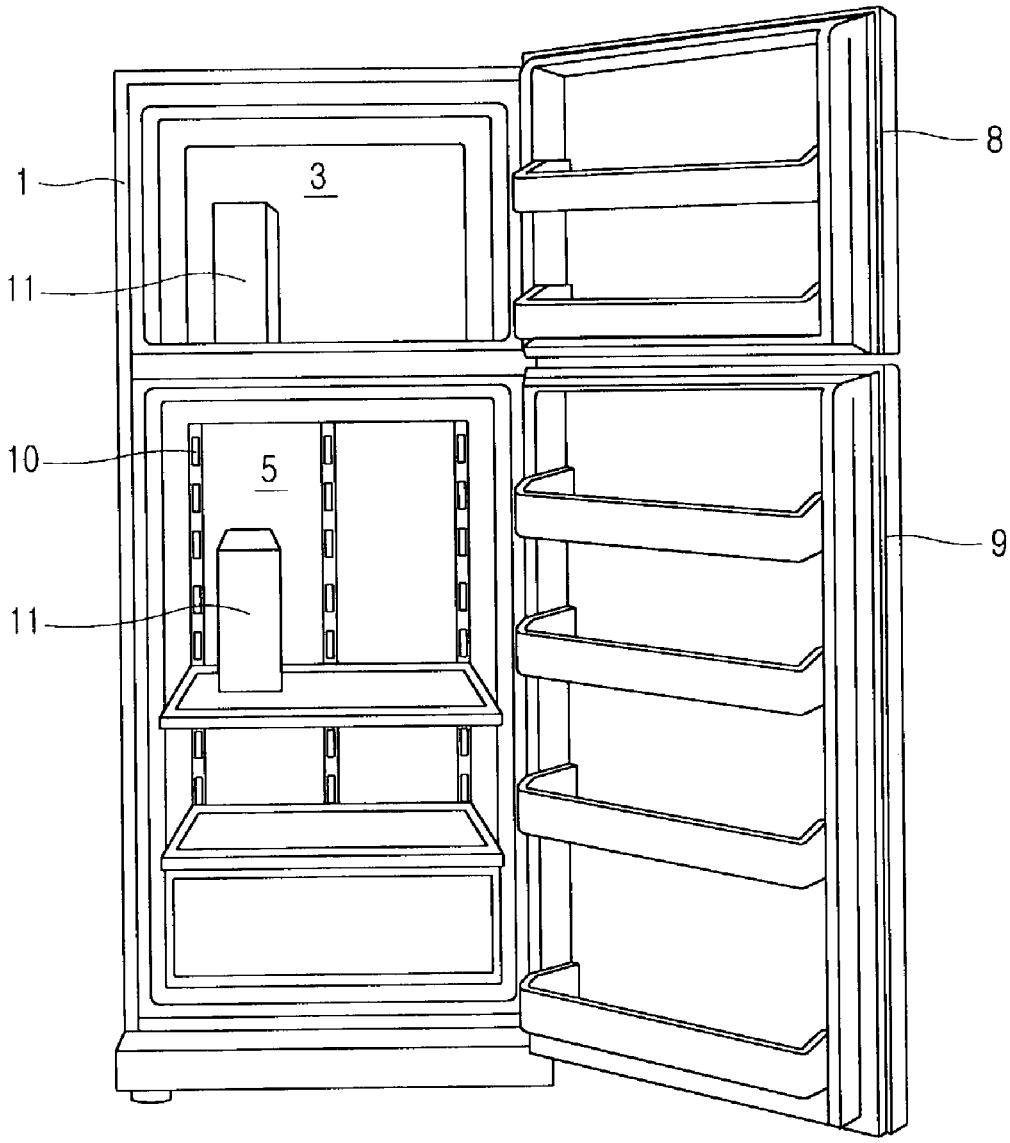
FIG. 2 CONVENTIONAL ART
FIG. 2 is a perspective view showing how a tall storage stuff is stored in the refrigerator in accordance with the conventional art.
Figure 3:
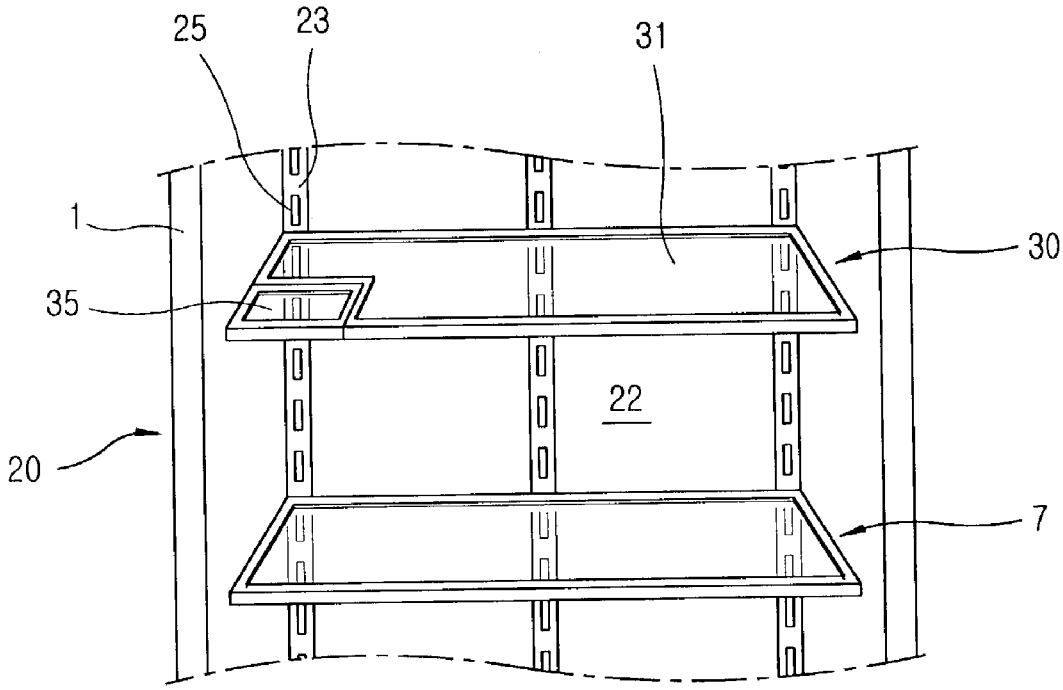
FIG. 3 is a perspective view showing a shelf for a refrigerator in accordance with the present invention.
Figure 4:
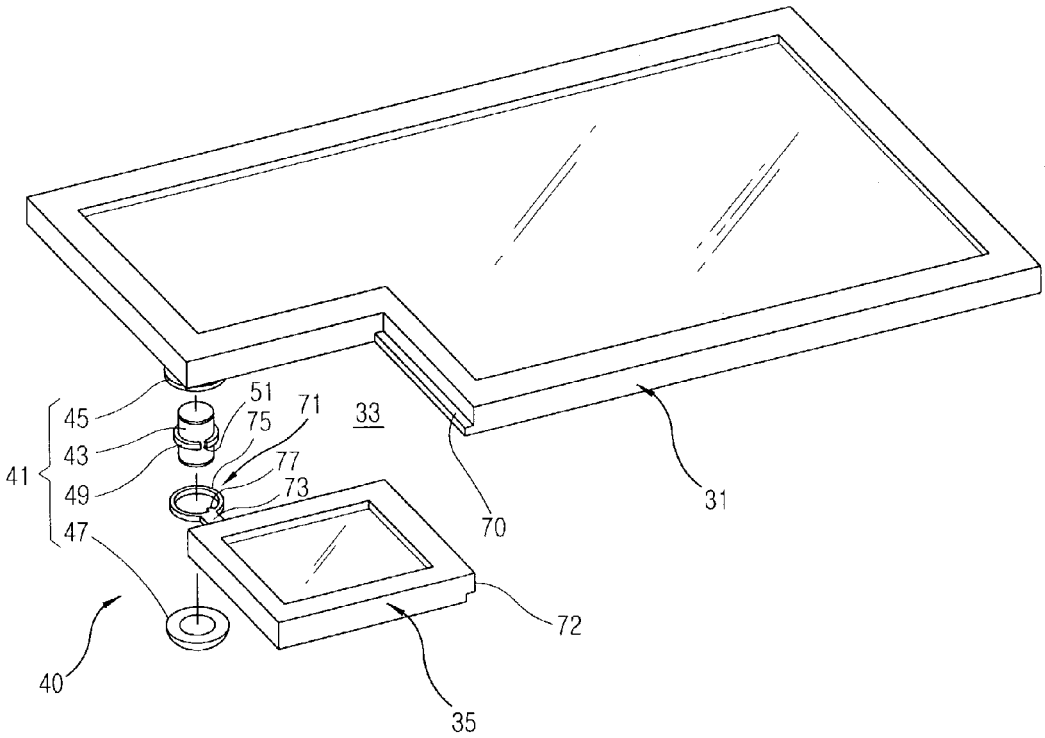
FIG. 4 is a perspective-exploded view showing a shelf for a refrigerator in accordance with the present invention.

FIG. 3 is a perspective view showing a shelf for a refrigerator in accordance with the present invention, and FIG. 4 is a perspective-exploded view showing a shelf for a refrigerator in accordance with the present invention.

As shown in FIG. 3, refrigerator shelves 7 and 30 for compartmenting a receiving space 22 in a refrigerator are formed as a plate with a certain thickness extended forwardly from a rear wall of the refrigerator so as to receive a storage stuff thereon, and detachably fixed at fixing slots 25 of a shelf holder 23 installed at the rear wall of the refrigerator so as to enlarge or reduce the space between shelves depending on the size of a received storage stuff, thereby suitably controlling the receiving space 22.

The shelf for a refrigerator in accordance with the present invention will now be described with reference to FIG. 4.

As shown in FIG. 4, the refrigerator shelf 30 in accordance with the present invention includes a shelf body 31 compartmenting a receiving space 22 of the refrigerator 1 to receive storage stuffs and having a space portion 33 cut out as wide as a certain area at a predetermined portion thereof; an open/close plate 35 rotatably mounted at a space portion 33 of the shelf body 31 and opening the space portion 33 of the shelf body 31 when a tall storage stuff is received; and a hinge unit 40 formed between the shelf body 31 and the open/close plate 35 and rotatably supporting the open/close plate 35.

The space portion 33 of the shelf body 31 is not limited in its horizontal width or vertical width but is preferred to be formed smaller than the half of the overall width of the shelf body 31 and provided at one of both sides of the shelf body 31.

The open/close plate 35 is formed as a plate with the same thickness as that of the shelf body 31 and with the same area as that of the space portion 33 of the shelf body 31.

The hinge unit 40 includes a hinge shaft 41 engaged at one side of the shelf body 31 and a hinge ring 71 rotatably inserted into the hinge shaft 41 and formed at one side of the open/close plate 35.

The hinge shaft 41 includes an upper side support portion 45 fixed at one lower surface of the shelf body 31; a rod portion 43 formed at a lower side of the upper side support portion 45 and having a certain length; a lower side support portion 47 formed at an end of the rod portion and preventing the hinge ring 71 from releasing; and a central support portion 49 integrally formed at an outer circumferential surface of the center of the rod portion 43 to compartment the rod portion 43 to an upper portion and a lower portion, and having at least one or more slots 51 formed in the circumferential direction so that the hinge ring 75 can be positioned and supported at the upper side of the rod portion 43 when the open/close plate 35 is positioned at the space portion 33 of the shelf body 31.

The upper side support portion 45, the rod portion 43 and the lower side support portion 47 of the hinge shaft 41 can be fixed by welding or by bonding, or can be fixed with means such as an engagement bolt, without being limited thereto.

The hinge ring 71 includes a connection portion 73 attached to the open/close plate 35 and formed with a slope; an annular ring portion 75 fixed at one end of the connection portion 73 and having an inner diameter corresponding to an outer diameter of the rod portion 43 of the hinge shaft 41, and at least one or more protrusions 77 protruded from the inner circumferential surface of the ring portion 75, formed with a size corresponding to the slot 51 of the central support portion 49, and formed to be movable vertically penetrating the slot 51.

As for the hinge ring 71, the inner diameter of the ring portion 75 is at least greater than the outer diameter of the rod portion 43 but smaller than the outer diameter of the central support portion 49, and the radial width of the protrusion 77 is formed as wide as a difference between a radius of the rod portion 43 and a radius of the central support portion 49.

Meanwhile, in order to support a load of a storage stuff mounted on the upper surface of the open/close plate 35, step portions 70 and 72 is preferably formed at a left corner of a front end of the margin of the shelf body 31 and at a right corner of a front end of the margin of the open/close plate 35.

With reference to FIG. 4, the step portion 70 can be formed in a stair form and not limited in its shape so long as it can support the load of the open/close plate.

The operation of the shelf for a refrigerator constructed as described above will now be explained.

First, referring to a state that the open/close plate 35 is installed, the protrusion 77 of the hinge ring 71 is positioned at an upper side of the central support portion 49 of the hinge shaft 41, and the shelf body 31 and the open/close plate 35 are leveled with each other, so that the upper surface of the open/close plate 35 and the upper surface of the shelf body 31 have the same height. Accordingly, the shelf 30 is maintained at the same height and thus a storage stuff can be stably received on the shelf 30.

Meanwhile, If a tall storage stuff is desired to be received into the receiving space 22 of the refrigerator 1, the open/close plate 35 is rotated centering around the hinge shaft 41 clockwise (in view of FIG. 4) in a state that the open/close plate 35 is mounted at the shelf body 31. Then, the protrusion 77 of the hinge ring 71 supported at the upper portion of the central support portion 49 of the hinge shaft 41 corresponds to the position of the slot 51 of the central support portion 49, so that the hinge ring 71 can be moved downwardly.

At this time, when the hinge ring 71 is lowered downwardly, the hinge ring 71 is positioned at the upper surface of the lower side support portion 47 and the open/close plate 35 is positioned at a lower side than the shelf body 31.

Figure 5:
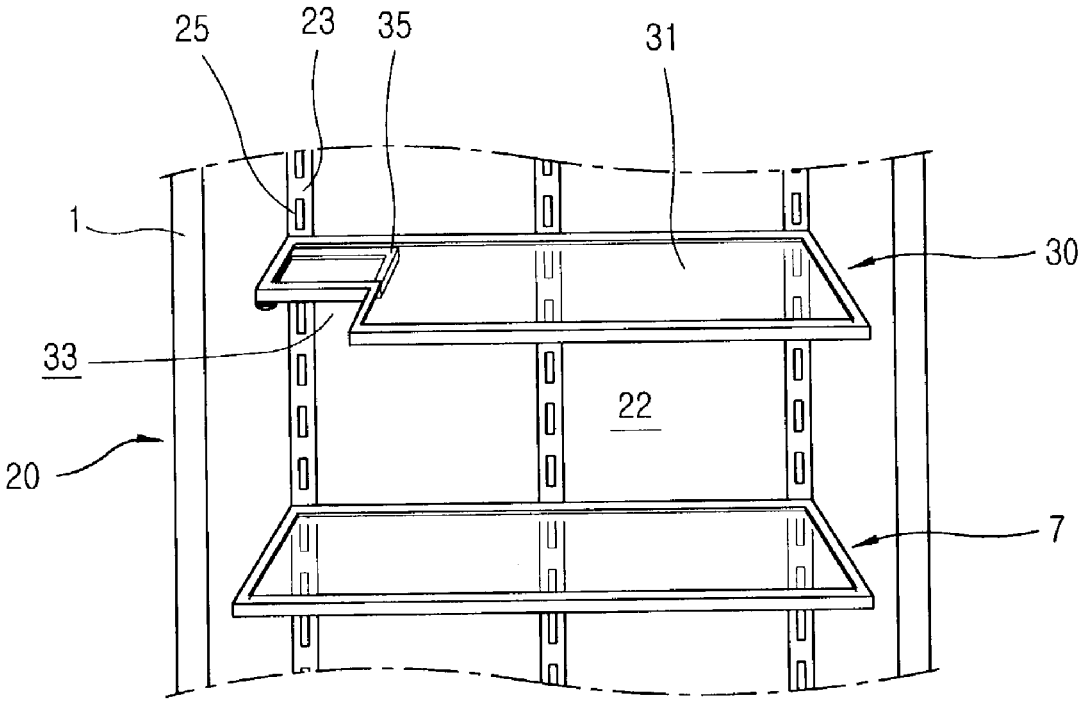
FIG. 5 is a perspective view showing how an open/close plate of the shelf is positioned at a lower portion of the shelf body in accordance with the present invention.

At this time, as shown in FIG. 5, when the open/close plate 35 is rotated counterclockwise centering around the rod portion 43 of the hinge shaft 41 to move the open/close plate 35 lower side of the shelf body 31, the space portion 33 of the shelf body 31 is opened, allowing the upper side and the lower side of the receiving space to communicate with each other.

Figure 6:
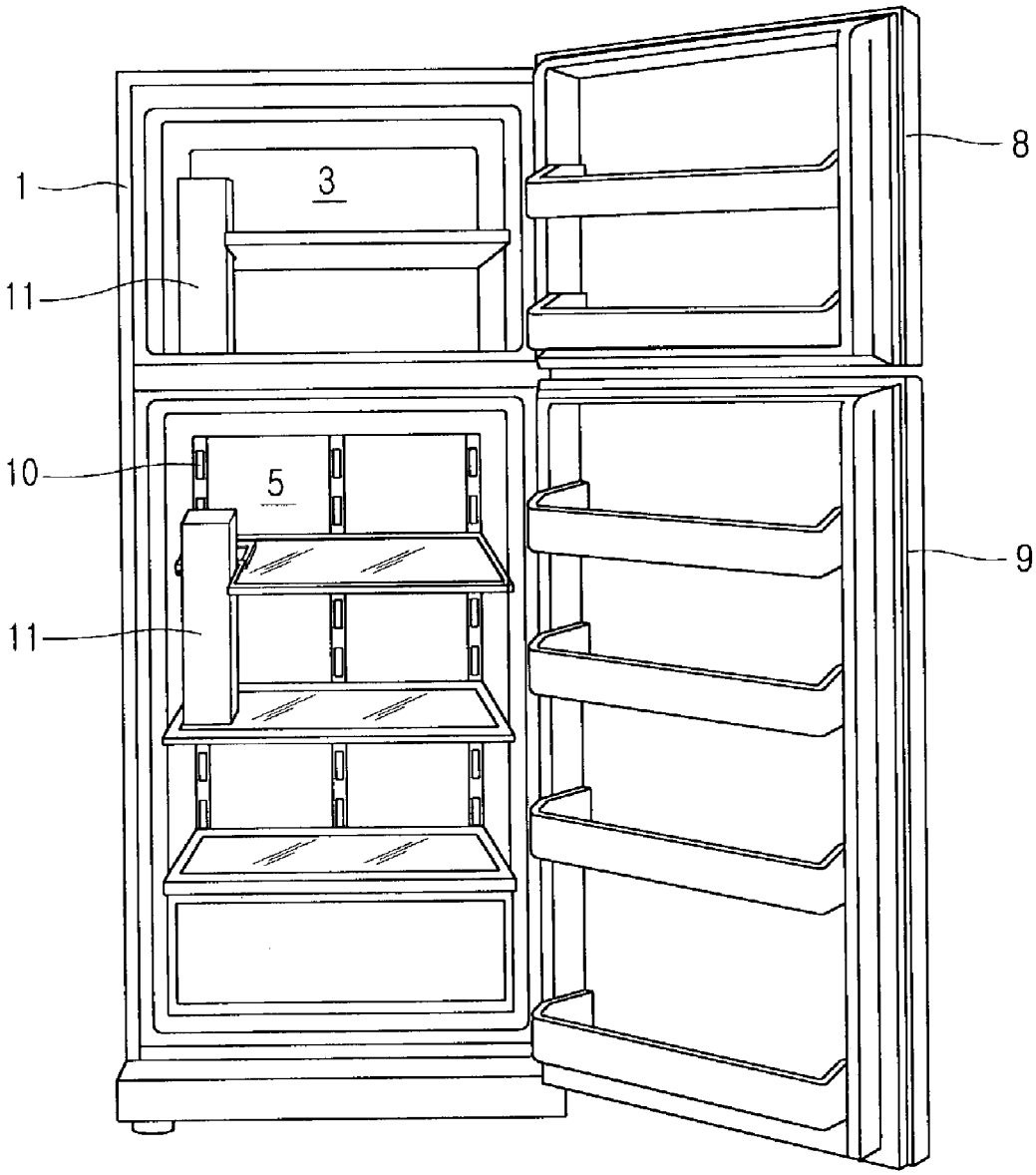
FIG. 6 is a perspective view showing how a tall storage stuff is stored in a refrigerator with the shelves in accordance with the present invention.

Accordingly, as shown in FIG. 6, the tall storage stuff 11 can be received passing through the space portion 33 of the shelf body 31.

Meanwhile, if the entire upper surface of the shelf 30 is desired to be used, the open/close plate 35 positioned at the rear lower side of the shelf body 31 is rotated clockwise and the hinge ring 75 is moved upwardly of the hinge shaft 43 by letting the protrusion 77 of the hinge ring 71 and the slot 51 formed at the central support portion 49 of the hinge shaft 41 to come to the same position, and then, the hinge ring 75 is rotated counterclockwise. Then, the protrusion 77 of the hinge ring 71 is supported at the upper surface of the central support portion 49. At this time, the open/close plate 35 closes the space portion 33 of the shelf body 31 and the upper surface of the open/close plate 35 and the upper surface of the shelf body 31 are leveled, so that the entire upper surface of the shelf 30 can be used.

In addition, as the step portion 70 formed at the left corner of the front end of the margin of the shelf body 31 and the step portion 72 formed at the right corner of the front end of the margin of the open/close plate 35 are insertedly joined to each other, the storage stuff received at the upper surface of the shelf 30 can be more stably supported.

As so far described, the shelf for a refrigerator of the present invention has the following advantages.

That is, since the space portion of the shelf body is selectively opened to receive a tall storage stuff and closed to utilize the entire space of the shelf, the receiving space inside the refrigerator can be effectively used.

In addition, since the open/close plate is positioned at a lower space of the shelf body by being supported by the hinge shaft, it is not necessary to provide a separate receiving unit for keeping the open/close plate or separately keep the open/close plate outside the refrigerator, accomplishing convenience in use.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A shelf for a refrigerator comprising:

a shelf body configured to form a receiving space in a refrigerator, the shelf body having a cut out portion;

an open/close plate rotatably mounted at the cut out portion;

a hinge ring mounted on a side of the open/close plate; and a hinge shaft mounted on the shelf body, wherein the hinge shaft is configured to be inserted into the hinge ring such that the open/close plate is rotatable relative to the shelf body, and wherein step portions formed at corresponding locations on the shelf body and the open/close plate prevent the open/close plate from being placed lower than the shelf body when the open/close plate is located in the cut out portion of the shelf body.

2. The shelf of claim 1, wherein the cut out portion of the shelf body is formed at a corner portion of one side of the shelf body.

3. The shelf of claim 1, wherein the open/close plate is configured to rotate about a vertical axis of rotation which is substantially coincident with the hinge shaft.

4. A shelf for a refrigerator comprising:

a shelf body configured to form a receiving space in a refrigerator, the shelf body having a cut out portion;

an open/close plate rotatably mounted at the cut out portion;

a hinge ring mounted on a side of the open/close plate; and a hinge shaft mounted on the shelf body, wherein the hinge shaft is configured to be inserted into the hinge ring such that the open/close plate is rotatable relative to the shelf body, wherein the hinge shaft comprises:

an upper side support portion fixed to a lower surface of the shelf body;

a rod portion formed at a lower side of the upper side support portion and having a certain length;

a lower side support portion formed at an end of the rod portion and configured to prevent release of the hinge ring; and a central support portion formed integrally at an outer circumferential face of the rod portion and configured to separate an upper portion of the rod portion and a lower portion of the rod portion, and to support the hinge ring so as to be positioned at the upper portion when the open/close plate is positioned at the cut out portion of the shelf body.

5. The shelf of claim 4, wherein at least one slot is formed at the central support portion in the circumferential direction.

6. The shelf of claim 5, wherein at least one protrusion is formed along an inner circumferential surface of the hinge ring, wherein the at least one protrusion is configured to pass through the at least one slot of the central support portion.

7. The shelf of claim 4, wherein the shelf body and the open/close plate are configured to form a substantially planar surface when the hinge ring is positioned above the central support portion.

8. The shelf of claim 7, wherein the open/close plate is positioned in a plane substantially parallel but not coplanar to the shelf body when the hinge ring is positioned below the central support portion.

9. A shelf for a refrigerator, comprising:

a first section configured to be supported by at least one interior wall of the refrigerator and comprising a primary storage surface; and a second section displaceably supported by the first section and comprising a secondary storage surface, wherein the second section is configured to rotate about an axis that is perpendicular relative to the storage surfaces, and wherein when the second section is in a first position, the secondary storage surface is substantially co-planar to the primary storage surface.

10. The shelf of claim 9, wherein the second section rotates about a hinge device disposed at an underside of the first section.

11. The shelf of claim 9, wherein when the second section is in a second position, the secondary storage surface is substantially parallel but not co-planar to the primary storage surface.

12. The shelf of claim 9, wherein when the second section is in the first position, a side surface of the first section abuts and supports a side surface of the second section.

13. The shelf of claim 9, further comprising a hinge device that includes:

a hinge guide mounted on the second section; and a hinge post mounted on an underside of the first section.

14. The shelf of claim 13, wherein the hinge guide comprises a hinge ring that surrounds the hinge post.

15. A shelf for a refrigerator, comprising:

a first section configured to be supported by at least one interior wall of the refrigerator and comprising a primary storage surface;

a second section displaceably supported by the first section and comprising a secondary storage surface, wherein the second section is configured to rotate about an axis that is perpendicular relative to the storage surfaces;

a hinge device that includes:

a hinge guide mounted on the second section; and a hinge post mounted on an underside of the first section, wherein the hinge guide comprises a hinge ring that surrounds the hinge post; and a circumferential ring which surrounds a mid portion of the hinge post, the circumferential ring having at least one aperture therein, wherein at least one protrusion extends inward from an inner circumference of the hinge ring, and wherein the at least one protrusion is configured to pass through the at least one aperture.

16. The shelf of claim 15, wherein when the second section is located in a first position that is substantially co-planar with the first section, the at least one protrusion on the hinge ring is located over and supported by the circumferential ring on the hinge post.

17. The shelf of claim 16, wherein when the second section is located at a second position that is not co-planar with the first section, the at least one protrusion on the hinge ring is located below the circumferential ring on the hinge post, and the at least one protrusion is supported by a support portion at a bottom of the hinge post.

18. A shelf for a refrigerator, comprising:

a shelf member having a first storage surface and an opposing lower surface and including a pass-through;

a plate displaceably mounted to the shelf member and having a second storage surface, wherein the plate is configured to selectively cover the pass-through in a first position where the plate is substantially co-planar with the shelf member, and wherein the plate is also configured to uncover the pass-through in a second position in which the second storage surface member substantially confronts the lower surface of the shelf member.

19. The shelf of claim 18, wherein the second storage surface remains substantially parallel to the first storage surface as the plate moves between the first and second positions.

20. The shelf of claim 18, further comprising a hinge assembly rotatably connecting the shelf member and the cover plate.

21. The shelf of claim 20, wherein the hinge assembly allows planar and non-planar displacement of the plate relative to the storage surface of the shelf member.

22. The shelf of claim 20, wherein the hinge assembly comprises:

a hinge shaft coupled to the lower surface of the shelf member; and a hinge ring coupled to the plate, wherein the hinge ring is coupled to and surrounds the hinge shaft.

23. The shelf of claim 18, wherein an area of the second storage surface is about 50% or less than an area of the first storage surface.

24. A shelf for a refrigerator, comprising:

a body portion having more than four sides; and a plate configured to rotate about a vertical axis of the body portion and the plate, and near a corner formed by two sides of the body portion, such that the plate is allowed to have an open and a closed position, wherein the plate is substantially coplanar with the body portion when the plate is rotated to the closed position.

25. The shelf of claim 24, wherein the plate is in a plane substantially parallel but not coplanar to the body portion when the plate is rotated to the open position.

26. The shelf of claim 24, wherein the body portion has six sides.

27. The shelf of claim 26, wherein the plate is configured to abut a corner portion of the body portion when the plate is in the closed position.

28. The shelf of claim 27, wherein two edges of the plate are configured to abut two corresponding sides of the body portion when the plate is in the closed position.

29. The shelf of claim 24, further comprising:

a hinge ring provided on a side portion of the plate; and a hinge shaft mounted on the body portion, wherein the hinge shaft is configured to be inserted into the hinge ring such that the plate is rotatable relative to the body portion.

30. A shelf for a refrigerator, comprising:

a body portion having more than four sides;

a plate configured to rotate near a corner formed by two sides of the body portion, such that the plate is allowed to have an open and a closed position;

a hinge ring provided on a side portion of the plate; and a hinge shaft mounted on the body portion, wherein the hinge shaft is configured to be inserted into the hinge ring such that the plate is rotatable relative to the body portion, wherein the hinge shaft comprises:

a first support portion fixed to the body portion;

a rod portion formed at a lower side of the first portion;

a second support portion formed at an end of the rod portion and configured to prevent release of the hinge ring; and a third support portion formed on an outer surface of the rod portion so as to separate upper and lower portions of the rod portion.

31. The shelf of claim 30, wherein the third support portion is configured to support the hinge ring when the plate is in the closed position.

32. The shelf of claim 24, wherein the plate has four sides and has an area smaller than the body portion.

* * * * *